US010662028B2

(12) United States Patent
Viita-Aho et al.

(10) Patent No.: US 10,662,028 B2
(45) Date of Patent: May 26, 2020

(54) METHOD FOR MOVING AN ELEVATOR CAR

(71) Applicant: KONE Corporation, Helsinki (FI)

(72) Inventors: Tarvo Viita-Aho, Hyvinkää (FI); Jussi Lähteenmäki, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 460 days.

(21) Appl. No.: 15/202,353

(22) Filed: Jul. 5, 2016

(65) Prior Publication Data

US 2017/0050821 A1 Feb. 23, 2017

(30) Foreign Application Priority Data

Aug. 18, 2015 (EP) ..... 15181348

(51) Int. Cl.
*B66B 5/02* (2006.01)

(52) U.S. Cl.
CPC ..... *B66B 5/027* (2013.01)

(58) Field of Classification Search
CPC ..... B66B 5/027
See application file for complete search history.

(56) References Cited

U.S. PATENT DOCUMENTS 1,873,807 A * 8/1932 Arnold ..... B66B 5/282 187/343
3,469,657 A * 9/1969 Sgroi ..... B66B 5/027 187/290
4,446,946 A * 5/1984 Kajiyama ..... G05B 19/232 187/295
4,635,907 A * 1/1987 Bialy ..... B66B 5/282 187/344
6,269,910 B1 * 8/2001 Fargo ..... B66B 3/00 187/287
7,637,357 B2 * 12/2009 Nakagawa ..... B66B 5/185 187/393
8,297,411 B2 * 10/2012 Hashimoto ..... B66B 1/285 187/288
9,051,155 B2 * 6/2015 Herkel ..... B66B 1/34
10,189,676 B2 * 1/2019 Hovi ..... B66B 1/343
(Continued)

FOREIGN PATENT DOCUMENTS

CN 101124141 A 2/2008
CN 102725218 A 10/2012
WO WO 2006/074688 A1 7/2006

*Primary Examiner* — Michael A Riegelman
(74) *Attorney, Agent, or Firm* — Birch, Stewart, Kolasch & Birch, LLP

(57) ABSTRACT

A method is provided for moving an elevator car in a rescue operation after at least one electric elevator brake have been actuated, whereafter the brake is re-opened via a manual brake opening device and operated to allow a movement of the elevator car to a next landing. The manual brake opening device is connected to an end limit indicator detector, which end limit indicator detector is configured to issue an end limit signal when elevator car arrives at an area of an end limit indicator at the end of its movement range of the elevator car in the elevator shaft. When the end limit indicator detector outputs an end limit signal to the manual brake opening device, the elevator brake is actuated by the manual brake opening device to stop the elevator car.

18 Claims, 1 Drawing Sheet

(56) References Cited

U.S. PATENT DOCUMENTS

| | | | | |
|---|---|---|---|---|
| 2003/0217895 | A1* | 11/2003 | Kigawa | B66B 5/282 187/344 |
| 2008/0185233 | A1* | 8/2008 | Tegtmeier | B66B 1/3492 187/290 |
| 2008/0202859 | A1* | 8/2008 | Tegtmeier | B66B 1/30 187/290 |
| 2009/0000877 | A1* | 1/2009 | Izard | B66B 1/3492 187/288 |
| 2010/0006378 | A1* | 1/2010 | Blasko | B66B 1/30 187/290 |
| 2011/0120810 | A1* | 5/2011 | Schroeder-Brumloop | B66B 5/027 187/290 |
| 2012/0193171 | A1* | 8/2012 | Kangas | B66B 1/3492 187/287 |
| 2012/0267200 | A1* | 10/2012 | Harkonen | B66B 1/34 187/294 |
| 2014/0299422 | A1* | 10/2014 | Kangas | B66B 5/0018 187/394 |
| 2016/0068368 | A1* | 3/2016 | Hovi | B66B 5/027 187/247 |

* cited by examiner

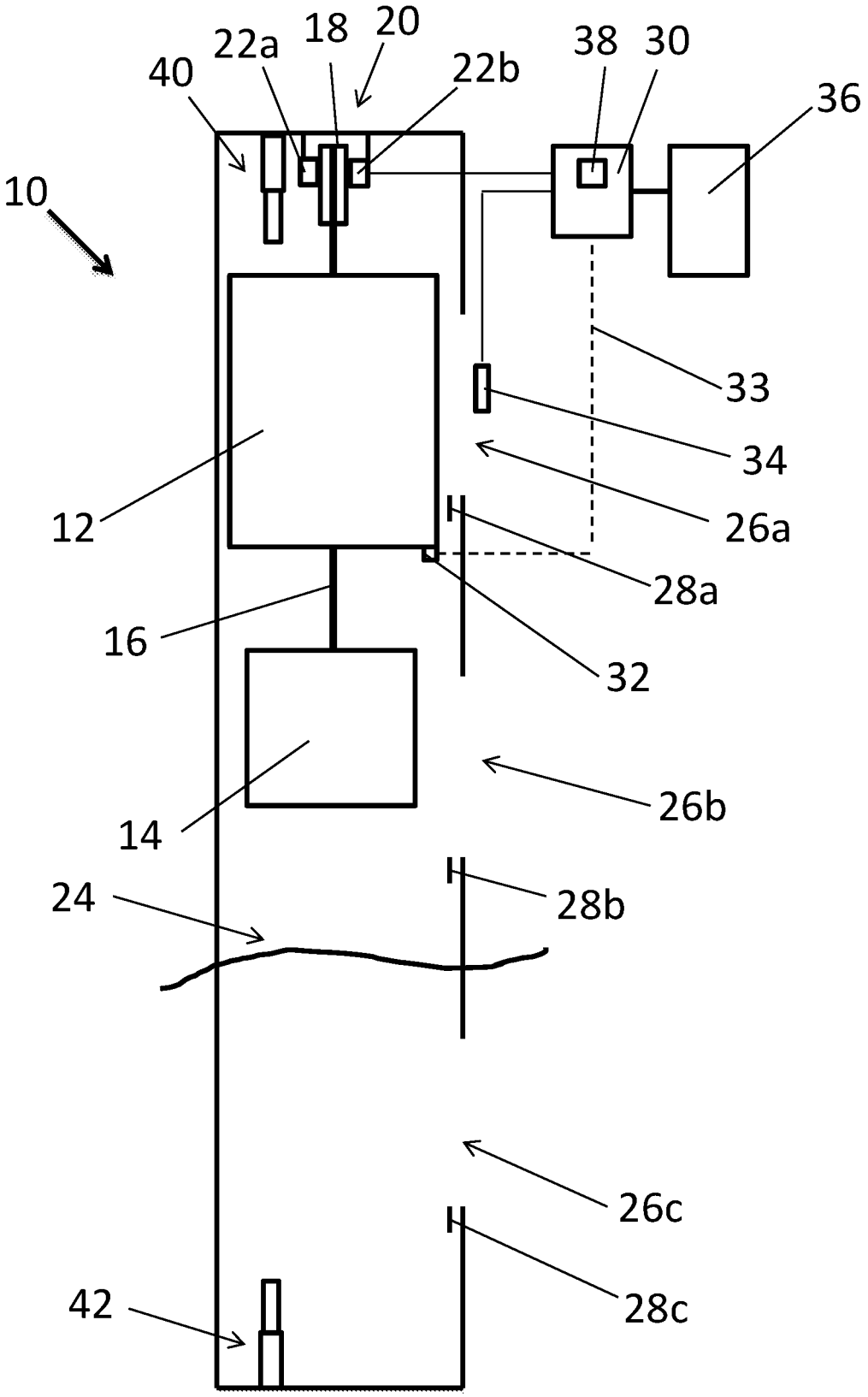
10
40
22a
18
20
22b
38
30
36
33
34
26a
12
28a
16
32
14
26b
24
28b
26c
42
28c

METHOD FOR MOVING AN ELEVATOR CAR

BACKGROUND OF THE INVENTION

The present invention relates to a method for moving an elevator car in an emergency ride after at least one electric elevator brake has been actuated by a safety device of an elevator.

DESCRIPTION OF THE RELATED ART

Elevators usually have a variety of safety functions for stopping the elevator car depending on the status of different elevator components. For example one safety contact is provided in connection with each landing door whereas other safety contacts are located in connection with the elevator drive and other components of the elevator. If one of these electric contacts opens the elevator drive stops and the electric elevator brake, usually two electric elevator brakes, are activated (deenergized) as to grip a rotating part of the drive, for example the traction sheave, to stop the elevator car. Also in case of power-off the car may stop somewhere in the shaft. In these situations the car normally doesn't stop in the entrance/exit area of a landing. Accordingly, elevators comprise a manual brake opening device which can be operated by a service technician to allow the movement of the elevator car to a nearby landing area. Such a manual brake opening device may be a mechanical device, as e.g. a manual brake release lever which is connected via a Bowden cable to the electric brake(s) or electrically as an electric brake operator. Sometimes, the elevator car has to be driven to the end of the car path. This leads to a situation where the car or the counterweight get into the upper and lower end regions of the elevator shaft which are secured with end buffers. In some designs these buffers require an approach speed of the elevator car below the limit speed of the overspeed governor. Therefore the overspeed governor cannot be used in connection with the car approach to the end areas of the elevator shaft.

Elevator safety code EN 81-20 5.6.6.1 requires that the counterweight speed must be reduced to the maximum collision speed for which the counterweight buffer is designed, also during manual rescue operation. Therefore, when reduced speed buffers are used, the overspeed governor may not be used for speed reduction.

SUMMARY OF THE INVENTION

It is therefore object of the present invention to facilitate the release of trapped persons after stop of the elevator car outside of a landing area.

The object of the invention is solved with the method according to claim 1 and with an elevator according to claim 8. Preferred embodiments are subject-matter of the corresponding dependent claims. Embodiments of the invention are also shown in the description and in the drawings. The inventive content may also consist of separate inventions, especially if the invention is considered in the light of sub-tasks or with respect to advantages achieved. In this case, some of the attributes contained in the claims below may be superfluous from the view point of separate inventive concepts. The features of different embodiments of the invention can be applied in connection with other embodiments within the scope of the basic inventive concept.

In the invention, the manual brake opening device, for example an electric brake operator, is connected to a end limit indicator detection means, which issues an end limit signal when getting into the vicinity of an end limit indicator located at the upper and/or lower shaft end. When the end limit indicator detection means outputs an end limit signal to the manual brake opening device, the elevator brake is automatically actuated by the manual brake opening device to stop the elevator car. With this invention it is ensured that the speed of the elevator car is reduced to an allowable range when it approaches the end buffer. In some kind of arrangements elevator codes, e.g. EN 81-1 require the approach of end buffers with a speed below the nominal speed of the elevator car. The nominal speed of an elevator is the regular speed between the landings and does not consider accelerations or deceleration periods in the car travel. An adapted location for the end limit indicator may be determined considering the car deceleration after activation (de-energizing) the brake and the distance between the car position at the point of brake activation and the end buffer and eventually the lowest/highest landing in the shaft. At the highest or lowest landing the trapped people can then be released.

Therefore, preferably the end limit indicator is fitted to the top and/or lower end in a sufficient distance to a corresponding end buffer in the elevator shaft to allow the drop of car speed from nominal speed to an admissible approach speed for the corresponding end buffer. Of course the end limit indicator may also be a door zone indicator of the highest and/or lowest landing. The electric brake operator may also comprise a delay circuit to delay the activation of the brake after getting the end limit signal which provides more freedom in the arrangement of the end limit indicator.

According to the invention the end limit detection means could also be configured to determine the position of door zone indicators, in which case the elevator car could also be stopped automatically in the door zones of a landing.

Preferably, the elevator has a safety gear and a governor configured to trigger the safety gear when elevator car speed exceeds a threshold value, which is higher than the dimensioned collision speed of the reduced buffer. Such a safety gear in connection with an overspeed governor is e.g. required by official codes to monitor the nominal speed of the elevator.

When the elevator brake is actuated by means of an end limit signal issued by the end limit indicator detection means, the counterweight speed may be limited during rescue operation to an allowed level before the counterweight hits the buffer.

For the detection of the end limit indicators in the shaft, conventional end limit indicator detection means can be used as for example optical, mechanical or magnetic detection means. Any of these different detection means ensures that end limit indicators located in the elevator shaft in connection with each elevator landing are reliably recognized.

The moving direction of the elevator car during an emergency run to release trapped people corresponds to the actual load status of the elevator car at the time of stopping of the elevator car. If the load of the elevator car is larger than the half of the nominal load, the elevator will run downwards (in an elevator with counterweight), whereas when the actual load is less than half of the nominal load, the elevator car will drive upwards when the electric elevator brake is released. This holds true for elevators with counterweight. For counterweight-less elevators, the moving direction will regularly be downwards.

It is clear for the skilled person that instead of one electric elevator brake official regulations generally require two electric elevator brakes which are usually arranged as to grip a rim of the rotor of the electric elevator drive or a surface or edge of the traction sheave.

Preferably, the brake is operated intermittently by the manual brake opening device during the emergency ride of the car to the next landing. This operating method ensures that the car speed does not become too high which could result in the activation of the gripping device by the overspeed governor. In this case the elevator car has to be set free by competent service technicians from the elevator company as the car has to be release from its wedged gripping position. In contrast thereto the release of the persons only by activation of the manual brake opening device can be performed by less experienced or competent person as for example the genitor.

In a preferred embodiment of the invention, the power for the manual brake opening device and for the end limit indicator detection means is taken from an independent emergency power supply which ensures that persons trapped in the elevator car can also be released when the public mains is down. The energizing (releasing) of the brakes by an electric brake operator and correspondingly the releasing of trapped passenger is then also possible when the electric public mains is off. The release with an electric brake operator as manual brake opening device has the advantage that the brake force has not to be generated manually via a mechanical means. Thus, by simply pushing an actuator switch of an electric brake operator the emergency ride can be managed by the electric brake operator without further interaction of the operator. Thus, quite inexperienced people like janitors or even passengers can release trapped people.

In case an independent emergency power supply is provided, this power supply is preferably connected to a loading circuit to charge the power supply during normal elevator operation. This ensures that the emergency power supply is always ready for use in any case of emergency, for example in case of power down of the public mains.

In a preferred embodiment of the invention, the manual brake opening device is designed to operate independently of an elevator control. Usually, all actions of the elevator are controlled by an elevator control and/or by an elevator group control. Anyway, in case of emergency, the elevator control may be shut down, for example in case of mains power off. Therefore, the ability of the manual brake opening device to operate independently of the elevator control offers the use of the manual brake opening device independently of the status of the elevator control.

The invention also refers to an elevator having at least one elevator car travelling in at least one elevator shaft. The elevator has a drive unit for moving the elevator car, for example via hoisting ropes, whereby the drive unit comprises at least one electric brake. The electric brake grips usually a rotating part of the drive unit or a part of the traction sheave. The elevator further comprises a manual brake opening device to operate the electric elevator brake in any case of emergency, for example in case of mains power off, to allow the movement of the elevator car to a next landing. According to the invention, the manual brake opening device comprises a signal connection to a end limit indicator detection means, whereby the manual brake opening device is designed to actuate the electric elevator brake to stop the elevator car upon receiving a signal of the end limit indicator detection means, with the effect that the elevator car speed is reduced to an appropriate value before approaching of hitting the upper or lower end buffer in the shaft. This, of course holds true for a car buffer as well as for a counterweight buffer. By this measure it is sufficient for an operator only to activate the manual brake opening device once, which manual brake opening device then drives the elevator car without any further interaction of the operator with reduced speed to an end buffer area. If as end limit switches door zone indicators are used, the invention can also be used to drive securely to a landing area to release people.

Preferably, the manual brake opening device is connected with an independent emergency power supply to enable the operation of the manual brake opening device independently of the status of the mains power supply.

Preferably, the independent emergency power supply is connected with a loading circuit for being charged during normal operation of the elevator. This ensures the operation of the independent emergency power supply in any case of accidents, where the manual brake opening device cannot be run with public mains power supply.

In a preferred embodiment of the invention, the manual brake opening device comprises a manually operable actuator switch to activate the manual brake opening device to open the elevator brakes for moving the elevator car to a next landing. Accordingly, the manual brake opening device could be actuated only by pushing or switching the manually operable actuator switch whereafter the manual brake opening device controls the movement of the elevator car without any further interaction with the operator.

Preferably, the end limit indicator detection means is connected, e.g. mounted to the elevator car whereby the signal of the end limit indicator detection means can be fed to the manual brake opening device via an elevator's car cable or via wireless transmission. Of course the end limit indicator means could also be mounted to other moved parts of the elevator as e.g. the ropes or the counterweight.

In a preferred embodiment of the invention, the manual brake opening device is mounted to the elevator shaft or is mounted in connection with a control panel. As the manual brake opening device usually comprises power switches and/or relays for energizing and de-energizing the electric elevator brakes windings the manual brake opening device is a rather voluminous and/or heavy arrangement which is best located in the vicinity of the electric elevator brakes to keep the length of high current leads short.

Generally, elevator brakes are usually comprising a winding/coil and a spring means. The spring means pushes at least one brake pad against a rotating brake surface located at the rotor of the electric motor/drive and/or at the traction sheave. That means that the brake brakes if de-energized. For releasing the brake the windings/coils have to be supplied with brake current which initiates the brake coils/windings to retract the brake pad away from the brake surface against the force of the spring means. Therefore the electric brake operator has to supply brake current to the brake to release it, which brake current is preferably taken from an emergency power supply.

In a preferred embodiment of the invention, the manual brake opening device is designed to operate independently of an elevator control which is for example accomplished via an own independent emergency power supply and an own control so that the activity of the manual brake opening device is totally independent of the function of the elevator control.

In a preferred embodiment of the invention, the manual brake opening device is an electric brake operator, i.e. an electric device comprising high power switches and/or relays to energize and de-energize the electric elevator brakes according to the requirements to drive the elevator car with a reduced speed to a next landing. In this connection, the manual brake opening device could be designed to operate to activate the brake intermittently. Via this means it would be ensured that the elevator car does not run freely after release of the brake but by the intermittent operation of the brake the speed of the elevator car is slowed down until the door indicator detection means indicates the arrival at a landing zone in which case the electric brake operator shuts the energy to the electric elevator brakes down which causes the brakes to grip a rotating part of the elevator drive and/or the traction sheave and to stop the elevator car. This technology therefore leads to a safe ride of the elevator car with a reduced speed to the next landing which will most reliably avoid any case of over-speed which could adversely lead to the activation of a gripping device.

The electric brake operator preferably comprises a manually operable actuator switch designed to activate the electric brake operator to release the brake, a power switch for energizing and de-energizing the brake and an operator control being responsive to the signal received from the end limit indicator detection means. This operator control can also have a speed circuit which is designed to intermittently activate the electric elevator brakes to slow down the car speed. Accordingly, with such an electric brake operator, the complete drive of the elevator car to a next landing can be controlled automatically without any manual interaction of an operator.

It is apparent for the skilled person that single components of the invention can be provided as a single component or as multiple components as for example the electric elevator brake which is normally provided at least two-fold. Furthermore, it is obvious for the skilled person that a visual contact to the elevator car is not necessary but may additionally be provided.

Following terms are used as synonyms: car—elevator car; brake—elevator brake;

BRIEF DESCRIPTION OF THE DRAWINGS

The FIGURE is a schematic drawing illustrating an example of the invention.

DESCRIPTION OF A PREFERRED EMBODIMENT

The inventive elevator 10 comprises an elevator car 12 and a counterweight 14 suspended on hoisting ropes 16 running over a traction sheave 18 of a drive unit 20. The drive unit 20 comprises two electric elevator brakes 22*a,b* which grip advertent brake surfaces of the traction sheave.

The elevator car 12 as well as the counterweight 14 are running vertically in an elevator shaft 24 which has several landings 26*a-c*. The FIGURE shows the highest landing 26*a* as well as the lowest landing 26*c*. In the top of the elevator shaft 24 an upper end buffer 40 is located. The end buffer can also be a buffer arrangement comprising car and counterweight buffers. In the shaft pit a lower end buffer 42 is located.

In the elevator shaft, preferably at the bottom of each landing 26*a*-26*c*, a door zone indicator 28*a-c* is located. The uppermost door zone indicator 26*a* is an upper end limit indicator whereas the lowest door zone indicator 26*c* is a lower end limit indicator. The elevator 10 comprises a manual electric brake opening device 30 in the form of an electric brake operator. The electric brake operator 30 is connected to both electric elevator brakes 22*a*, 22*b* as well as for example via the car cable with a door zone/end limit indicator detection means 32 located at the elevator car 12, e.g. under its bottom. The door zone indicator detection means is configured to issue a signal to the electric brake operator 30 when getting in the area of a door zone indicator (end limit indicator) 28*a-c*. The electric brake operator 30 operates autonomously from any elevator control of the elevator 10 and is therefore connected with an independent emergency power supply 36, e.g. an accumulator which is preferably connected to a loading circuit (not shown) during normal elevator operation. The electric brake operator 30 is further connected to a manually operable actuator switch 34 to start operation of the electric brake operator 30.

The electric brake operator 30 is powered by the independent emergency power supply 36 and comprises an operator control 38 to operate the electric elevator brakes 22*a*, 22*b* in a desired manner for an emergency ride of the elevator car from a stopping position to the next landing 26*a,b,c* to release trapped passengers. The operation of the electric brake operator 30 is started by a push on the manually operable actuator switch 34, for example by a janitor of a building. The push of the manually operable actuator switch initiates power switches in the electric brake operator 30 to energize the elevator brakes 22*a,b* to release the brake surfaces of the traction sheave whereafter the elevator car starts moving. The operator control 38 can be designed to operate the electric elevator brakes 22*a*, 22*b* intermittently as to avoid an excessive acceleration and/or speed of the elevator car during its ride to the next landing. The elevator car 12 as well as the counterweight 14 locates at both ends of the hoisting ropes move until the door zone indicator detection means 32 detect the presence of a door zone indicator 28*a*-28*c*, which causes the operator control 38 to initiate the electric brake operator 30 to de-energizes the electric elevator brakes 22*a*, 22*b* which causes the elevator car to stop in the landing zone. Now trapped people in the elevator car can be released by manually opening the landing door and the car door.

The invention is particularly advantageous for the approach of the upper and lower end buffers 40, 42 in the shaft, as by the end limit indicator detection means 32 and the corresponding end limit indicators 28*a,c* the brake 22 can via the electric brake operator be actuated early enough so that the elevator car speed is sufficiently reduced before getting in the end buffer area. Therefore, by the present invention a required speed reduction for the car approach can be realised via the interaction of the end limit indicators 28*a,c* and the end limit indicator detection means 32. Of course the end limit indicators do not need to be the uppermost and lowermost door zone indicators but can be realised with separate indicators aside from the door zone indicators.

It is clear for the skilled person that the elevator 10 does not necessarily need to have a counterweight but the elevator car can be suspended in a closed rope loop having suspension ropes above the elevator car and compensating ropes on the lower side of the elevator car. Also the roping of the elevator can be different, e.g. a 2:1 roping can be used.

Furthermore, it is clear that the invention can be realized in a single elevator or in an elevator group or in an elevator multi-group consisting of several linked elevator groups. The door zone indicator detection means may be an optical, magnetic or mechanical detector means.

The invention is not delimited to the embodiment of the FIGURE but may be varied within the scope of the appended patent claims.

LIST OF REFERENCE NUMBERS

10 Elevator
12 Elevator car

14 Counterweight
16 Hoisting ropes
18 Traction sheave
20 Drive unit
22*a,b* Elevator brakes
24 Elevator shaft
26*a-c* Landings
28*b* Door zone indicator
28*a,c* End limit indicator
30 Electric brake operator
32 Door zone/End limit indicator detection means
34 Manually operable actuator switch
36 Independent emergency power supply
40 Upper end buffer
42 Lower end buffer

The invention claimed is:

1. A method for moving an elevator car in a rescue operation after at least one electric elevator brake has been actuated, whereafter the brake is re-opened via a manual brake opening device and operated to allow a movement of the elevator car to a next landing, said method comprising the steps of:

connecting the manual brake opening device to an end limit indicator detector, the end limit indicator detector being configured to issue an end limit signal when the elevator car arrives at an area of an end limit indicator at the end of the movement range of the elevator car in the elevator shaft;

activating the brake intermittently when the at least one elevator car is moving to control a speed of the at least one elevator car during emergency operation; and when the end limit indicator detector outputs an end limit signal to the manual brake opening device, actuating the elevator brake by the manual brake opening device to stop the elevator car.

2. The method according to claim 1, wherein the end limit indicator is fitted to the top and/or lower end in a sufficient distance to a corresponding end buffer in the elevator shaft to allow the drop of car speed from nominal speed to an admissible approach speed for the corresponding end buffer.

3. The method according to claim 2, wherein the end limit indicator is a door zone indicator of the highest and/or lowest landing.

4. The method according to claim 2, wherein the elevator has a safety gear and a governor configured to trigger the safety gear when elevator car speed exceeds a threshold value, which is higher than the dimensioned collision speed of the reduced buffer.

5. The method according to claim 2, wherein the brake is operated intermittently by the manual brake opening device.

6. The method according to claim 1, wherein the end limit indicator is a door zone indicator of the highest and/or lowest landing.

7. The method according to claim 6, wherein the elevator has a safety gear and a governor configured to trigger the safety gear when elevator car speed exceeds a threshold value, which is higher than the dimensioned collision speed of the reduced buffer.

8. The method according to claim 6, wherein the brake is operated intermittently by the manual brake opening device.

9. The method according to claim 1, wherein the elevator has a safety gear and a governor configured to trigger the safety gear when elevator car speed exceeds a threshold value, which is higher than the dimensioned collision speed of the reduced buffer.

10. The method according to claim 1, wherein the power for the manual brake opening device for controlling and energizing the elevator brake and the power for the end limit indicator detector is taken from an independent emergency power supply.

11. The method according to claim 1, wherein the manual brake opening device is designed to operate independently of an elevator control.

12. An elevator comprising:

at least one elevator car travelling in an elevator shaft; and a drive unit for moving the elevator car, wherein the drive unit comprises at least one electric brake, and the elevator comprises a manual brake opening device to operate the at least one electric brake in an emergency to allow the movement of the elevator car to release trapped passengers, wherein the manual brake opening device comprises a signal connection to an end limit indicator detector, wherein the manual brake opening device is designed to actuate the at least one electric brake to stop the elevator car upon receiving a signal of the end limit indicator detector, and wherein the manual brake opening device comprises an operating control configured to activate the brake intermittently when the at least one elevator car is moving to control a speed of the at least one elevator car during emergency operation.

13. The elevator according to claim 12, wherein the manual brake opening device is connected with an independent emergency power supply.

14. The elevator according to claim 12, wherein the elevator has at least one end buffer at the top and/or bottom of the elevator shaft, and wherein the end limit indicator is located at such a distance from the corresponding end buffer, that upon activation of the elevator brake initiated by the end limit indicator detector via the manual brake opening device, the speed of the elevator car is reduced to an admissible approach speed for the end buffer below the nominal speed of the elevator.

15. The elevator according to claim 12, wherein the manual brake opening device comprises a manually operable actuator switch to activate the manual brake opening device to open the elevator brakes.

16. The elevator according to claim 12, wherein the manual brake opening device is designed to operate independently of an elevator control.

17. The elevator according to claim 12, wherein the manual brake opening device is an electric brake operator.

18. The elevator according to claim 17, wherein the electric brake operator comprises a manually operable actuator switch designed to activate the electric brake operator to release the brake, at least one power switch for energizing and de-energizing the brake and an operator control being responsive to the signal received from the end limit indicator detector.

* * * * *